United States Patent [19]

Samo

[11] Patent Number: 4,629,442

[45] Date of Patent: Dec. 16, 1986

[54] ARTIFICIAL EYE FOR DOLL

[75] Inventor: Harvey W. Samo, Maplewood, N.J.

[73] Assignee: Margon Corporation, Rahway, N.Y.

[21] Appl. No.: 525,333

[22] Filed: Aug. 22, 1983

[51] Int. Cl.[4] ..... A63H 3/38

[52] U.S. Cl. ..... 446/389; 446/393; 623/4

[58] Field of Search ..... 446/389, 392, 393, 341, 446/342, 343, 344, 345, 346, 347, 348; 3/13

[56] References Cited

U.S. PATENT DOCUMENTS

| | | | |
|---|---|---|---|
| 1,187,926 | 6/1916 | Pudlin | 446/389 |
| 1,373,579 | 4/1921 | Wendtland | 446/392 |
| 1,763,312 | 6/1930 | Marcus | 446/389 |
| 1,782,818 | 11/1930 | Grubman | 446/389 |
| 1,979,321 | 11/1934 | Dunner | 446/392 |
| 2,068,950 | 1/1937 | Hamilton | 446/389 |
| 2,175,831 | 10/1939 | Cesare et al. | 446/393 |
| 2,601,107 | 6/1952 | Ellett | 446/392 |
| 2,618,898 | 11/1952 | Wilhelm | 446/345 |
| 2,997,811 | 8/1961 | Cohn | 446/345 |
| 3,286,394 | 11/1966 | Brudney | 446/389 |
| 4,393,619 | 7/1983 | Murch | 446/392 |

FOREIGN PATENT DOCUMENTS

| | | | |
|---|---|---|---|
| 1165376 | 10/1958 | France | 446/392 |
| 415884 | 11/1947 | Italy | 446/392 |
| 436763 | 3/1949 | Italy | 446/392 |

*Primary Examiner*—F. Barry Shay

*Attorney, Agent, or Firm*—Blum Kaplan Friedman Silberman & Beran

[57] ABSTRACT

A plastic eye having an appearance closely resembling a glass-blown eye is formed of two generally spherical halves, secured together by solvent or cement at confronting flanges. The spherical halves are formed of clear glass or plastic and the front half is a hollow molding having an internal planar surface. The various eye components are pad printed on the planar surface and then the interior of the shell is given a white coating. Slots can be provided in the front spherical shell wherein an artificial eyelash may be received. A forward central projection on the front half better simulates the cornea of a real eye.

20 Claims, 5 Drawing Figures

FIG. 4
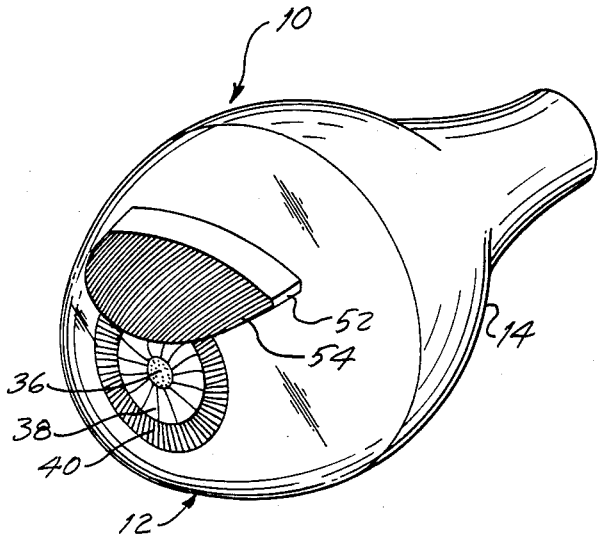
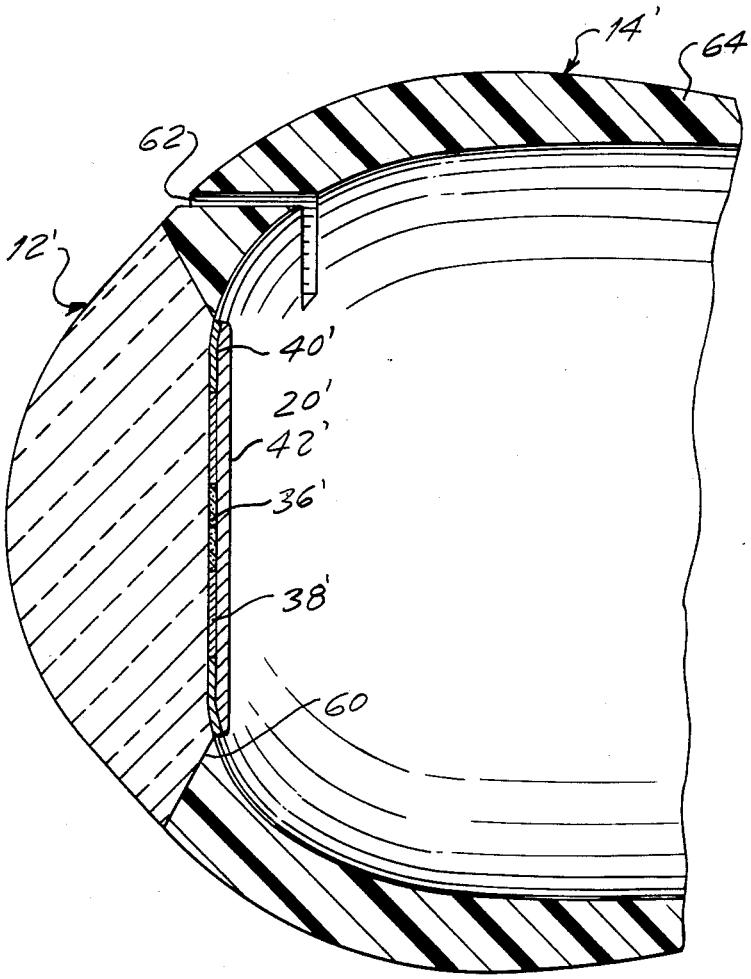
FIG. 5

ARTIFICIAL EYE FOR DOLL

BACKGROUND OF THE INVENTION

This invention relates generally to a artificial eye of the type used for dolls and toys and more particularly, to a glass or other artificial eye which closely simulates a real eye and is inexpensive to produce. Dolls eyes have been made in many ways so as to closely approach the appearance of the human eye. By far the best results have been obtained with individually glass-blown eyes. This method, however, requires a highly skilled glass blower, and is slow and cumbersome. As a result, these eyes are not only very expensive, but also are generally in short supply. Further, it is desirable for use in dolls that some artificial eyes include an eyelash. A glass-blown eye can not be made with a slot or other provision to permit application of an eyelash. Therefore, eyelashes, when required, must be applied individually and directly to the doll head. This also is a difficult, slow, and therefore expensive operation.

Also, in the past, doll eyes have been made of metal, metal and plastic in combination, and entirely of plastic materials. The quality of the eye appearance has varied, but never approached the quality of the glass-brown eye or for that matter, the human eye. These eyes, which were not glass-blown, are being used as stationary, sleeping, or side glancing eyes. They are designed for mass production and can, therefore, be produced at a cost that allows wide usage. However, all of these eyes have severe limitations with regard to quality of appearance and the ease of varying appearance. As a result, doll designers are limited in their freedom of choice with regard to eye appearance.

What is needed is a glass or other artificial eye for dolls which closely approaches the human eye in appearance, is readily available in a wide range of appearances, and is economical to produce.

SUMMARY OF THE INVENTION

Generally speaking, in accordance with the invention, a glass or plastic eye having an appearance closely resembling a glass-blown, and in fact, human eye is provided. The eye is formed of two generally spherical halves which are secured together by solvent or by cementing at the confronting flanges. The spherical halves are formed of pressed or cast clear glass or clear plastic, for example, polystyrene, and the front half is a hollow molding which is pad printed in the area depicting iris and pupil of the eye on a planar surface within the generally spherical shape. After the various eye components have been pad printed, the interior of the shell is sprayed white. Slots can be provided in the front spherical shell wherein an artificial eyelash may be received. A forward central projection on the front half better simulates the cornea of a real eye.

Accordingly, it is an object of this invention to provide an improved artificial eye for dolls which closely resembles a real eye and can be mass produced in a wide variety of colors and appearances.

Another object of this invention is to provide an improved artificial eye for dolls which has the appearance of a glass-blown artificial eye.

A further object of this invention is to provide an improved artificial eye for dolls which is pressed or cast or clear glass or molded of plastic and pad-printed for low production costs.

Still another object of this invention is to provide an improved artificial eye for dolls which can readily provide for attachments of artificial lashes.

Yet another object of this invention is to provide an improved artificial eye for dolls which has a "FOLLOW-EYE" effect, giving the impression to the person looking at the doll that the eyes follow him in all directions.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 is a perspective view of a artificial eye for dolls in accordance with the invention having an artificial eyelash.

FIG. 5 is an alternative embodiment of an artificial eye in accordance with the invention.

DESCRIPTION OF THE PREFERRED EMBODIMENTS

Figure 1:
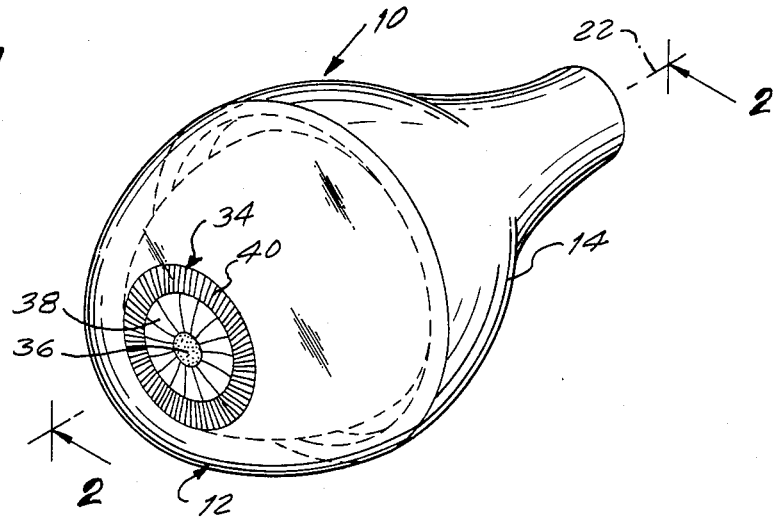
FIG. 1 is a perspective view of a artificial eye for dolls in accordance with the invention.

An artificial eye 10 in accordance with the invention is comprised of an anterior half 12 and a posterior half 14. The anterior half 12 is substantially hemispherical on its outer surface, as explained more fully hereinafter, and is partially hollow as a result of a circular recess 16 formed in the back surface 18. The recess 16 has a flat bottom surface 20 which lies transversely to the longitudinal axis 22 of the artificial eye 10 and is joined to the back surface 18 by a generally spherical wall 24. The diameter 28 of the flat surface 20 is approximately equal to the diameter of the iris of the completed eye. The back surface 18 is cut away at the outer periphery to form a circular shoulder flange 26 for mating with the posterior half 14.

The anterior half 12 is formed of pressed or cast glass or transparent plastic. The exact characteristics of the plastic material may be varied depending on the specific end results and usage which are desired. Polystyrene has provided satisfactory results.

The posterior half 14 is a hollow shell which is generally spherical in the forward portion for joining with the anterior half 12 in a smooth continuous surface. The thickness 30 of the posterior half 14 is substantially equal to the annular width of the shoulder flange 26. The posterior half 14 tapers rearwardly to form a hollow tube portion 32.

The posterior half 14 can be of any material suitable for joining, for example, with a cement or solvent with the anterior half 12. Fabrication of the two halves 12, 14 of the same material is suitable but not necessary. The exterior shape of the posterior half 14 simulates the contours of a glass brown artificial eye, but other shapes may also be provided within the scope of the invention so long as suitable mating surfaces are provided to engage the shoulder flange 26 of the anterior half 12. It should also be understood that in some applications, the posterior half 14 is not necessary and the front or anterior portion 12 of the artificial eye suffices when suitably mounted to the doll or other toy. The posterior half 14 also may be of a solid material so long as suitble mating surfaces are provided for engagement with the anterior half 12.

Eye components, which are formed in the anterior half 12 on the flat surface 20 of the recess 16 comprise an iris 34 and pupil 36. These elements of the eye are pad-printed on the flat surface 20 of the recess 16. First a black pupil 36 is printed substantially concentrically with the longitudinal axis 22 of the artificial eye 10. Then starlines 38 of suitable color, for instance grey-white, are printed surrounding the black pupil 36. The starlines 38 can be irregular lines or patches of a lighter color, for example blue for a blue eye. A dark outer ring 40 is printed to represent the outer extremity of the iris 34 with a half tone fading toward the center. For a blue eye, for example, a dark blue outer ring 40 is provided. Then an overprint 42 covers the total iris area in a color corresponding to the color of the iris 34. After these inks are dry, a white lacquer or white enamel is sprayed in the recess 16 to cover the area 24 beyond the iris 34. The iris 34 and pupil 36 which are already printed act as a mask so that the white lacquer or enamel, forming a layer 43 which covers the rear surface 24, does not change the appearance of the pupil or iris.

Printing of the pupil and the dark outer ring can be combined into a single printing step if there is no need for a high level of color refinement by printing both the pupil 36 and the outer ring 40 is black. In such a case the outer ring 40 is an annulus having a width in the order of 5 to 10 thousandths of an inch with a suitable black half tone area to effect the appearance of a darker outer iris.

An eye 10 which is made in this manner can be mass produced on dial or chain-fed machines and the clear halves 12, 14 can be molded of plastic or pressed or cast glass, and hand fed or automatically loaded. Without difficulty, a three, four or five color iris-pupil imprint can be made depending upon the number of printing steps in the overall process. Both the design of the iris appearance and the color of each imprint can be changed easily and at low cost.

The pupil/iris design can duplicate anything that photoetching can achieve. In the finest art reproductions, a capability for color and variations is nearly limitless. Combined with an easy exchange of colors, this process is uniquely versatile.

A more realistic simulation of a real eye is provided by modification to the outer surface of the anterior half 12. In such an alternative embodiment, the outer surface is comprised of three smoothly blended portions. The first portion 44 is substantially a sphere with a radius 45 having its origin on the longitudinal axis 22 near the back surface 18 of the anterior half 12, approximately in the plane of the shoulder flange 26. The most forward portion 46 of the anterior half 12 is also substantially spherical with a radius 47 less than the radius 45 of the first portion 44 and having its origin on the longitudinal axis 22 at a point approximately midway within the recess 16. The forward portion 46 and the rear portion 44 of the anterior half 12 are connected by a tangential conical segment 48. Thus, the forward portion 46 of the artificial eye 10 extends beyond the surface of a sphere which would be generated as a continuation of the rear portion 44, and more accurately simulates the cornea of a real eye and the appearance of a mouth-blown glass eye.

Although the bottom surface 20 has been described above and illustrated to be flat, it should be understood that in alternative embodiments in accordance with the invention, this surface may be somewhat curved within limits determined by the pad-printing techniques, to be either closer or further from the front of the eye to provide particular visual effects. Also, it should be understood that the surface 20 may be substantially perpendicular to a radius line of the outer spherical surface which line is not parallel to the longitudinal axis 22, thus providing an angled "glance" to the artificial eye.

Figure 3:
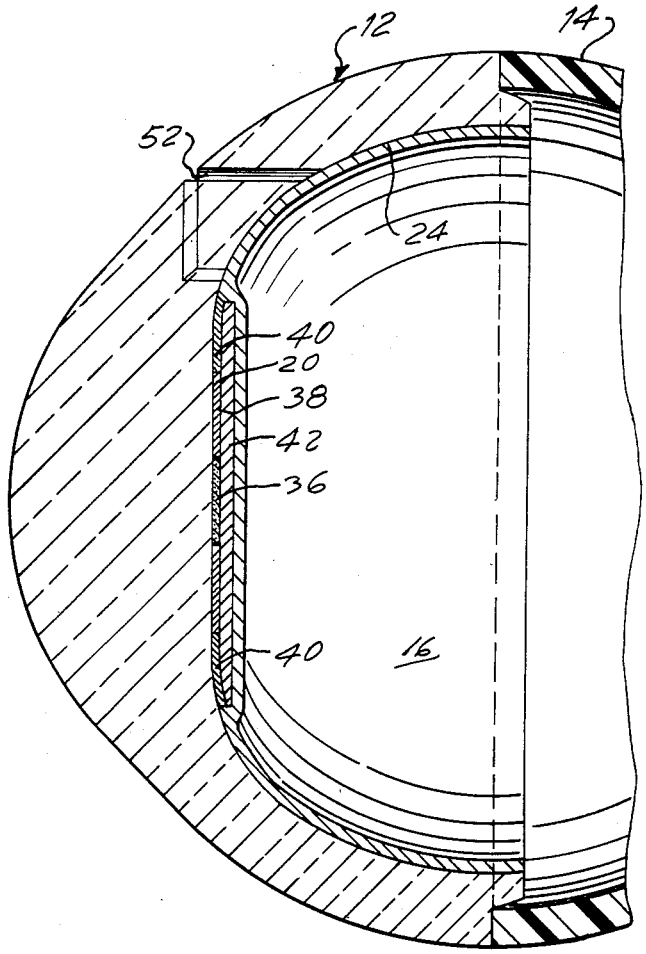
FIG. 3 is a partial view similar to FIG. 2 showing an alternative embodiment of an artificial eye for dolls in accordance with the invention including a slot for receiving an artificial eyelash therein.

In another alternative embodiment of a artificial eye in accordance with the invention, a slot 52 is formed in the surface of the anterior half 12 (FIG. 3) during molding or in a subsequent operation in a position to receive a curved artificial eyelash 54. An assembled artificial eye with an eyelash received within the slot 52 and attached thereto with an adhesive is illustrated in perspective in FIG. 4. Thus a joining of eye to lash is easily achieved avoiding a time consuming process of attachment required with a blown glass eye where no slot is available on the eye surface.

The posterior half 14 can be formed of a white material such that when the two halves 12, 14 are joined, an artificial eye 10 is produced which closely simulates the relatively rare and costly glass blown eye.

Another alternative embodiment of a artificial eye in accordance with the invention is illustrated in FIG. 5, wherein the artificial eye is comprised of a front piece 12' and a rear piece 14'. The front piece 12' and rear piece 14' are similar to the halves 12, 14, of FIG. 2 in contours except that the parting line between the front and rear pieces 12', 14' is a conical surface 60 where joining is effected, for example, by cement. As will be apparent upon a comparative examination of FIGS. 2 and 5, the recess of the front half 12 is eliminated and those portions removed from the anterior half 12 to form the front piece 12' have been added to the shape of the posterior half 14 to make the rear piece 14'.

Figure 2:
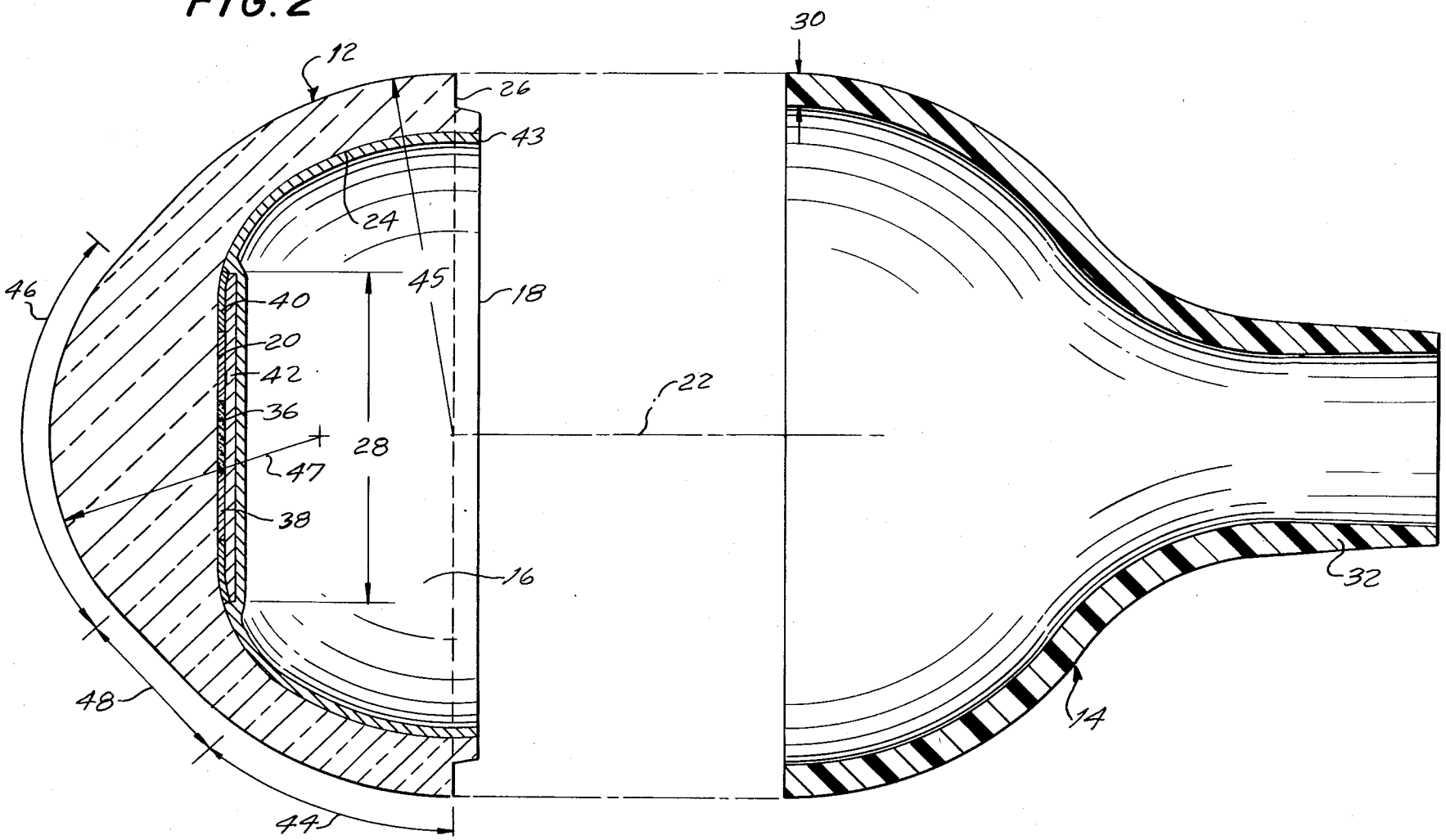
FIG. 2 is an exploded sectional side view to an enlarged scale taken along the line 2—2 of FIG. 1.

The front piece 12' is formed of clear plastic and has the eye structure printed on the planar surface 20' by techniques as previously described. The rear piece 14' is formed of white plastic and joined to the front piece 12' just at the outer periphery of the dark outer ring 40' of the iris. Accordingly, the need to coat the inside surface of the recess in the embodiment of FIG. 2 is eliminated in the embodiment of FIG. 5 and production costs are reduced. The conical surface 60 provides for accurate and simple positioning of the front piece 12' with the iris/pupil printed thereon, printing being effected either before or after assembling of the front piece 12' to the rear piece 14'.

The rear piece 14' is molded with a slot 62 around a portion of its periphery such that an artificial eyelash can be attached in the slot 62. In an alternative embodiment no slot for an eyelash is provided. The end 64 of the rear piece 14' can be completed in any contour suitable to the application, for example, as shown in FIG. 2, or can be fully open to allow easy printing of eye structure on the front piece 12' after the pieces 12', 14' have been joined together.

In all embodiments the printed colors and coatings are protected from scratching and other defacement after the eye is attached to the doll.

Other modifications can be made to the artificial eye 10 in accordance with the invention to adapt the eye for motion, eyelids, etc. which are conventional in the art of producing toys and dolls. It should be understood that the drawings are to an enlarged scale and the thicknesses of the printed ink layers are exaggerated for clarity of illustration.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An artificial eye for toys comprising:

a first half comprising a generally spherical front surface generated around a longitudinal axis, said generally spherical front surface comprising a first spherical segment having a first radius and a second spherical segment having a second radius smaller than said first radius, and a conical segment positioned between said first and second spherical segments, said spherical and conical segments being concentric about a common axis, said conical segment tangentially joining both said spherical segments, a protrusion being formed extending forwardly of said first spherical segment and simulating the cornea of an eye;

a flat surface to the rear of said generally spherical front surface, the flat surface being intersected by said axis and being a portion of a plane passing through said generally spherically front surface;

eye portions including an iris and a pupil printed on said flat surface, said first half being at least in part transparent, allowing said eye portions to be visible through said second spherical segment.

2. An artificial eye as claimed in claim 1, wherein said flat surface is substantially perpendicular to a radial line from said longitudinal axis to said generally spherical surface.

3. An artificial eye as claimed in claim 1, wherein said flat surface is substantially perpendicular to said longitudinal axis.

4. An artificial eye as claimed in claim 1, wherein said flat surface is intersected at its center by said axis.

5. An artificial eye as claimed in claim 1, and further comprising a second half, said second half being adapted to join to said first half rearwardly of said front spherical surface with a smooth joint between said second half and said spherical surface.

6. An artificial eye as claimed in claim 1, wherein said pupil and said iris are positioned on said base surface as the product of a pad-printing technique.

7. An artificial eye as claimed in claim 6, wherein said pupil and at least a portion of said iris are positioned on said flat surface as the products of independent printing steps.

8. An artificial eye as claimed in claim 6, wherein said iris includes a darkened outer periphery, starlines between said darkened periphery and said pupil, and a colored layer over at least said starlines.

9. An artificial eye as claimed in claim 8, wherein said pupil, darkened periphery, starlines and colored layer are the individual products of individual pad-printing operations, said colored layer being applied last to cover at least said starlines.

10. An artificial eye as claimed in claim 9 and further comprising a curved surface extending away from said iris, said curved surface being white to simulate the white of an eye.

11. An artificial eye as claimed in claim 10, and further comprising a second half, said second half being adapted to join to said first half rearwardly of said front spherical surface with a smooth joint between said second half and said spherical surface, said white curved surface extending away from said iris being a portion of one of said first half and said second half.

12. An artificial eye as claimed in claim 1, wherein said first half is generally shaped as a hemisphere, said generally spherical front surface being joined to a rear surface, said rear surface having a recess formed therein, said flat surface being an interior surface of said recess.

13. An artificial eye as claimed in claim 12, wherein said recess includes a segment of a sphere, said flat surface being joined to said rear surface by a portion of a spherical surface.

14. An artificial eye as claimed in claim 12, and further comprising a second half, said second half being adapted to join to said first half rearwardly of said front spherical surface with a smooth joint between said second half and said spherical surface.

15. An artificial eye as claimed in claim 8, and further comprising a slot formed in said generally spherical front surface, said slot being adapted for receiving therein an artificial eyelash.

16. An artificial eye as claimed in claim 15, wherein said first half is formed of a material selected from the group consisting of molded transparent plastic, cast glass and pressed glass.

17. An artificial eye as claimed in claim 1, and further comprising a slot formed in said generally spherical front surface, said slot being adapted for receiving therein an artificial eyelash.

18. An artificial eye as claimed in claim 17, wherein said first half is formed of a material selected from the group consisting of molded transparent plastic, cast glass and pressed glass.

19. An artificial eye for toys comprising:

an anterior portion formed as a unitary element of a material selected from the group consisting of molded transparent plastic, cast clear glass, and pressed clear glass, said anterior portion comprising a generally spherical outer surface and a concave inner surface, both surfaces being generated around a common longitudinal axis, there being a flat surface formed integrally with said concave inner surface and centered on said longitudinal axis, the plane of said flat surface transecting said anterior portion;

eye portions printed on said flat surface, said eye portions comprising at least a pupil and a surrounding an iris;

a slot formed in said generally spherical front surface, said slot being adapted to receive an artificial eyelash;

a second portion which is adapted to join said anterior portion to the rear of said generally spherical outer surface at a smooth annular joint; and a white surface surrounding said iris and comprising at least a portion of said anterior portion.

20. The artificial eye of claim 19 in which the generally spherical outer surface comprises a first spherical segment having a first radius, a second spherical segment having a second radius which is smaller than said first radius, and a conical segment tangentially joining said second spherical segment to said first spherical segment so that a protusion is formed which extends forwardly of said first spherical segment, simulating the cornea of an eye.

* * * * *